US008342709B2

(12) United States Patent
Lueken et al.

(10) Patent No.: US 8,342,709 B2
(45) Date of Patent: Jan. 1, 2013

(54) LIGHT EMITTING DIODE MODULE, AND LIGHT FIXTURE AND METHOD OF ILLUMINATION UTILIZING THE SAME

(75) Inventors: Thomas C. Lueken, Diamond Bar, CA (US); Michael S. Neuer, Covina, CA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/289,338

(22) Filed: Oct. 24, 2008

(65) Prior Publication Data

US 2010/0103668 A1 Apr. 29, 2010

(51) Int. Cl.
*F21V 1/00* (2006.01)

(52) U.S. Cl. ..... 362/240; 362/345; 362/249.03

(58) Field of Classification Search ..... 362/250, 362/541, 547, 549.01–249.03, 297, 298, 362/341, 373, 345, 294, 240, 241, 247, 249.01–249.03
See application file for complete search history.

(56) References Cited

U.S. PATENT DOCUMENTS

| | | | | |
|---|---|---|---|---|
| 3,562,513 | A | 2/1971 | Jaffe, Jr. | |
| 4,337,507 | A | 6/1982 | Lasker | |
| 4,760,509 | A * | 7/1988 | Panagiotou | 362/285 |
| 5,199,784 | A * | 4/1993 | Hempleman | 362/294 |
| 5,580,156 | A * | 12/1996 | Suzuki et al. | 362/184 |
| 5,893,633 | A | 4/1999 | Uchio et al. | |
| 5,947,587 | A | 9/1999 | Keuper et al. | |
| 6,213,627 | B1 | 4/2001 | Abersfelder et al. | |
| 6,234,645 | B1 | 5/2001 | Borner et al. | |
| 6,234,648 | B1 | 5/2001 | Borner et al. | |
| 6,250,774 | B1 | 6/2001 | Begemann et al. | |
| 6,481,874 | B2 * | 11/2002 | Petroski | 362/373 |
| 6,517,218 | B2 | 2/2003 | Hochstein | |
| 6,582,100 | B1 | 6/2003 | Hochstein et al. | |
| 6,676,279 | B1 | 1/2004 | Hubbell et al. | |
| 6,874,911 | B2 * | 4/2005 | Yoneda | 362/294 |
| 6,942,361 | B1 | 9/2005 | Kishimura et al. | |
| 6,997,583 | B2 * | 2/2006 | Broelemann | 362/471 |
| 7,237,936 | B1 * | 7/2007 | Gibson | 362/547 |
| 7,244,058 | B2 * | 7/2007 | DiPenti et al. | 362/547 |
| 7,252,408 | B2 | 8/2007 | Mazzochette et al. | |

(Continued)

FOREIGN PATENT DOCUMENTS

JP 5198205 8/1993

(Continued)

*Primary Examiner* — Julie Shallenberger
(74) *Attorney, Agent, or Firm* — Alan I. Cantor; Mark S. Bicks; Alfred N. Goodman

(57) ABSTRACT

LED module, arrays of LED modules, luminaires incorporating such arrays, and methods of illumination where the configuration of respective components facilitates any one or more of desired angle, location and shape of illumination provided by the LEDs. LED modules are selectively disposed on a carrier plate. Each of the LED modules includes a substantially planar LED circuit board with LED chips disposed thereon, a heat sink formed of heat transmitting material and having a mounting surface for accommodating an LED circuit board to dissipate heat from the LED chips, and a reflector with its reflective surface disposed with respect to the LED chips to direct the emitted light toward an axis of illumination extending away from and substantially perpendicular to a plane containing the planar LED circuit board. The heat sink, the LED circuit board and the reflector are arranged such that the axis of illumination is not perpendicular to a plane containing the surface illuminated by the light emitted from the LED chips.

44 Claims, 12 Drawing Sheets

U.S. PATENT DOCUMENTS

| | | | | |
|---|---|---|---|---|
| 7,275,841 | B2 | 10/2007 | Kelly | |
| 7,278,761 | B2 | 10/2007 | Kuan | |
| 7,281,818 | B2 | 10/2007 | You et al. | |
| 7,281,820 | B2 * | 10/2007 | Bayat et al. | 362/245 |
| 7,329,027 | B2 * | 2/2008 | Phelan et al. | 362/294 |
| 7,347,706 | B1 | 3/2008 | Wu et al. | |
| D568,521 | S | 5/2008 | Compton | |
| D576,330 | S | 9/2008 | Ruud et al. | |
| D576,331 | S | 9/2008 | Ruud et al. | |
| D578,697 | S | 10/2008 | Zheng et al. | |
| 7,497,596 | B2 * | 3/2009 | Ge | 362/294 |
| 7,972,035 | B2 | 7/2011 | Boyer | |
| 8,132,944 | B2 | 3/2012 | Ruud et al. | |
| 2001/0030866 | A1 | 10/2001 | Hochstein | |
| 2002/0008976 | A1 * | 1/2002 | Gronemeier et al. | 362/545 |
| 2003/0021113 | A1 * | 1/2003 | Begemann | 362/231 |
| 2003/0189831 | A1 * | 10/2003 | Yoneda | 362/294 |
| 2004/0202007 | A1 * | 10/2004 | Yagi et al. | 362/545 |
| 2005/0122064 | A1 | 6/2005 | Chevalier | |
| 2005/0157504 | A1 | 7/2005 | Vanden Eynden | |
| 2005/0201098 | A1 * | 9/2005 | DiPenti et al. | 362/294 |
| 2006/0215416 | A1 * | 9/2006 | Lucas et al. | 362/545 |
| 2007/0076414 | A1 | 4/2007 | Holder et al. | |
| 2007/0206164 | A1 | 9/2007 | Beeson | |
| 2007/0285920 | A1 * | 12/2007 | Seabrook | 362/240 |
| 2008/0078524 | A1 | 4/2008 | Wilcox et al. | |
| 2008/0080162 | A1 | 4/2008 | Wilcox et al. | |
| 2008/0080189 | A1 * | 4/2008 | Wang | 362/294 |
| 2008/0080190 | A1 * | 4/2008 | Walczak et al. | 362/294 |
| 2008/0080196 | A1 | 4/2008 | Ruud et al. | |
| 2008/0112161 | A1 | 5/2008 | Summers | |
| 2008/0212329 | A1 | 9/2008 | Duguay et al. | |
| 2008/0285265 | A1 | 11/2008 | Boissevain | |
| 2009/0086472 | A1 | 4/2009 | Kinnune | |
| 2009/0323330 | A1 | 12/2009 | Gordin et al. | |
| 2010/0110671 | A1 | 5/2010 | Gordin et al. | |
| 2010/0195326 | A1 | 8/2010 | Boxler et al. | |

FOREIGN PATENT DOCUMENTS

| | | |
|---|---|---|
| JP | 2000030511 | 1/2000 |

* cited by examiner

SECTION X-X

SECTION XVI-XVI

LIGHT EMITTING DIODE MODULE, AND LIGHT FIXTURE AND METHOD OF ILLUMINATION UTILIZING THE SAME

FIELD OF THE INVENTION

The present invention is generally in the field of lighting and luminaires utilizing light emitting diodes (LEDs) to facilitate desired illumination. More particularly, the invention provides an LED module, arrays of LED modules, luminaires incorporating such arrays, and methods of illumination where the configuration of respective components facilitates any one or more of desired angle, location and shape of illumination provided by the LEDs.

BACKGROUND

Recently, commercial, as well as residential, lighting applications have been transitioning to the use of LEDs where arrays of LED modules provide illumination in applications such as street lighting, office building lighting, and many other outdoor and indoor applications.

LEDs perform well in the industry, but there are often problems with aiming of the light output from LEDs in a desired direction and pattern. In general, LEDs emit light in all directions away from the circuit board thereof. Consequently, a good portion of light emitted by an LED can be wasted because it is not directed towards a desired area of illumination. Conventionally, such side-emitters and asymmetrical distribution LEDs are controlled with lenses and prisms. Such control optics tend to decrease the amount of lumens (or candlepower) produced by any given fixture utilizing LEDs because of the loss of lumens through the lens or prism material. Other conventional means for directing light emitted by LEDs include use of reflective surfaces which, while avoiding light losses suffered by lenses and prisms, may be more difficult to configure to achieve the desired illumination direction or patterns.

Another known design consideration associated with the use of LEDs in lighting fixtures is heat dissipation. Accordingly, LED modules for use in LED arrays often incorporate heat sinks to facilitate dissipation of heat generated by the LEDs during operation.

Conventional configurations that attempt to address the above-noted considerations in LED and other lighting applications are described in, for example, U.S. Design Pat. Nos. D576,331, D576,330 and D568,521, U.S. Patent Applications Publication Nos. 2008/0080196, 2007/0076414, 2008/0078524, 2008/0212329 and 2008/0080162, and U.S. Pat. Nos. 5,580,156, 6,942,361, 6,234,648, 5,947,587, 3,562,513, 4,337,507, 6,676,279, 7,252,408, 7,347,706, the entire disclosures of all of which are incorporated herein by reference.

While the conventional configurations described in the above disclosures provide different means to address various considerations associated with utilization of LEDs, a need still exists for a luminaire that can be readily and efficiently configured to utilize LEDs and direct light emitted from the LEDs at a desired angle and in a desired pattern.

SUMMARY OF THE INVENTION

Accordingly, exemplary embodiments of the present invention address at least the above-noted needs by providing an LED module and array of LED modules, as well as a light fixture and illumination methods that facilitate an increase in candlepower and accurate aiming of light output by LEDs onto the surface to be illuminated.

Another object of the present invention is to provide a reflector module that is adaptable to all area and garage lighting products.

A further object of the present invention is to provide a unique LED board with at least three diodes positioned horizontally with a quick connection for promoting ease of assembly.

Still another object of the present invention is to provide extruded heat-sink modules to dissipate the heat on LED circuit boards.

Yet another object of the present invention is to provide an LED module for creating multiple distinct lighting distributions wherein the center beam exits the luminaire at an angle of about 70° from the carrier plate when the carrier plate is substantially parallel to the surface to be illuminated.

A further object of the present invention is to provide an LED module that is easily replaceable and environment-friendly to eliminate the need to replace an entire fixture when an LED no longer emits light.

The foregoing objects are addressed by exemplary embodiments of the present invention that provide structures and methods of illumination where one or more LED modules are selectively disposed on a carrier plate. Each of the LED modules includes an LED circuit board with one or more LED chips disposed thereon, a heat sink formed of heat transmitting material and having a mounting surface for accommodating the LED circuit board to dissipate heat from the LED chip(s), and a reflector with its reflective surface disposed with respect to the LED chip(s) to direct the emitted light emitted toward an axis of illumination extending away from and essentially perpendicular to a plane of the LED circuit board. The heat sink, the LED circuit board and the reflector are arranged such that the axis of illumination is not perpendicular with respect to a plane of a surface illuminated by the light emitted from the LED chip(s).

According to exemplary embodiments of the present invention, by forming the LED module in this manner and selectively configuring such modules on a carrier plate, distinct lighting distributions can be achieved that exit a lighting fixture employing the carrier plate at an angle of about 70° with respect to the surface to be illuminated.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure and illustrate non-limiting, exemplary implementations of certain exemplary embodiments of the present invention.

Throughout the drawings, like reference numerals will be understood to refer to like parts, components, and structures.

DETAILED DESCRIPTION OF THE INVENTION

Several embodiments of the present invention will now be described in detail with reference to the annexed drawings. In the following description, a detailed description of known functions and configurations incorporated herein has been omitted for conciseness and clarity.

Figure 1:
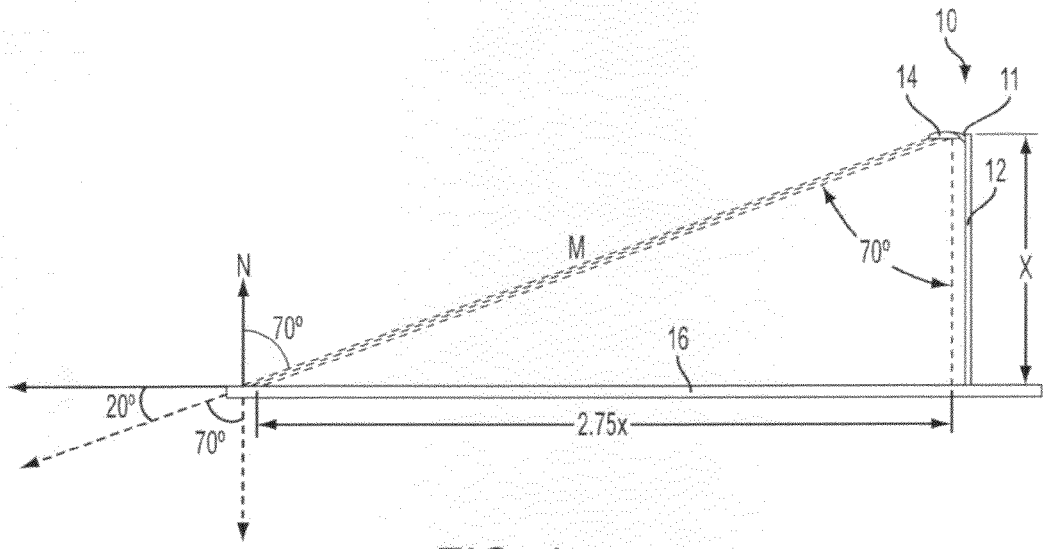
FIG. 1 is a side elevational view of a luminaire configured and emitting light according to an exemplary embodiment of the present invention.
Figure 2:
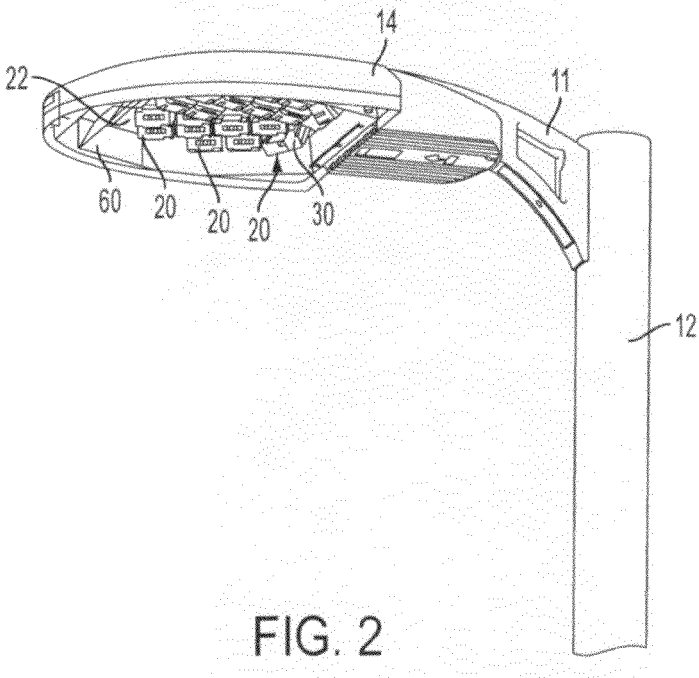
FIG. 2 is a magnified side perspective view of the luminaire of FIG. 1 implementing LED modules according to an exemplary embodiment of the present invention.
Figure 3:
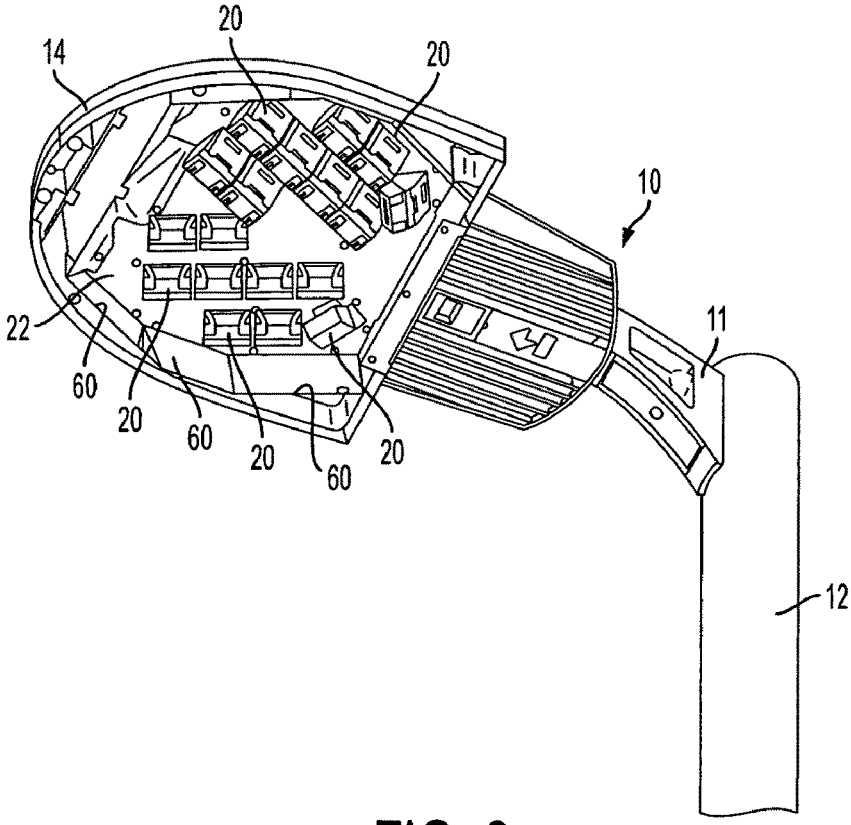
FIG. 3 is a magnified bottom perspective view of the luminaire as seen in FIGS. 1 and 2.
Figure 4:
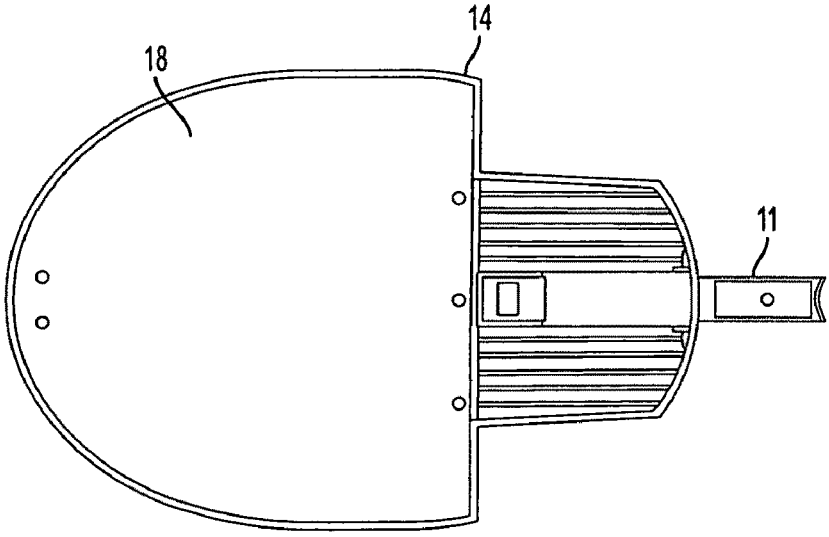
FIG. 4 is a magnified bottom plan view of the luminaire as seen in FIGS. 1-3 having a reflective cover according to an exemplary embodiment of the present invention.

Turning to FIGS. 1-3, according to an exemplary embodiment of the present invention, it may be desirable to configure a luminaire 10 to emit light at an angle of approximately 70° with respect to the surface 16 to be illuminated, as shown in FIG. 1. In an exemplary implementation, such a luminaire 10 may include pole or support structure 12 and housing 14 that accommodates, as illustrated in the examples of FIGS. 2-4, an LED array having LED modules 20. The housing 14 may include a transparent cover 18 (shown in FIG. 4) that protects the LED array.

Assuming, for simplicity of explanation only, that a davit arm 11 extends the housing 14 away from pole 12 by a negligible distance, then the direction of light emitted from housing 14 mounted on pole 12 at a height "x" with respect to the surface 16 to be illuminated should be such that the distance at which the axis corresponding to maximum candlepower of light M emitted from the LED modules 20 hits the surface 16 to be illuminated at a distance of approximately 2.75× (i.e., about 2.75 times the height of the pole).

For example, if implemented as a street light where the height of pole 12 is 20 feet, light M should be emitted from the LED arrays configured in the housing 14 of the luminaire 10 such that the brightest area of illumination is at a distance of about 55 feet from the base of pole 12. The support structure can be a pole or wall if the housing 14 is wall mounted. A davit arm 11, or any other analogous connecting structure, for connecting the housing 14 to the support structure is optional.

Referring now to FIGS. 5, 6, 6*a*, and 6*b*, according to exemplary embodiments of the present invention, the LED module 20 comprises a heat sink 30 formed of heat transmitting material, such as metal, an LED circuit board 40 having at least one LED 42 mounted thereon, and a reflector 50 coupled to and supported by, directly or indirectly, the heat sink 30 and configured with respect to the LED 42 for directing light emitted therefrom. According to an exemplary embodiment, an array of LED modules 20 can be formed by securing a plurality of LED modules 20 onto a structure, such as a carrier plate 22 as illustrated in, for example FIG. 6.

Figure 6:
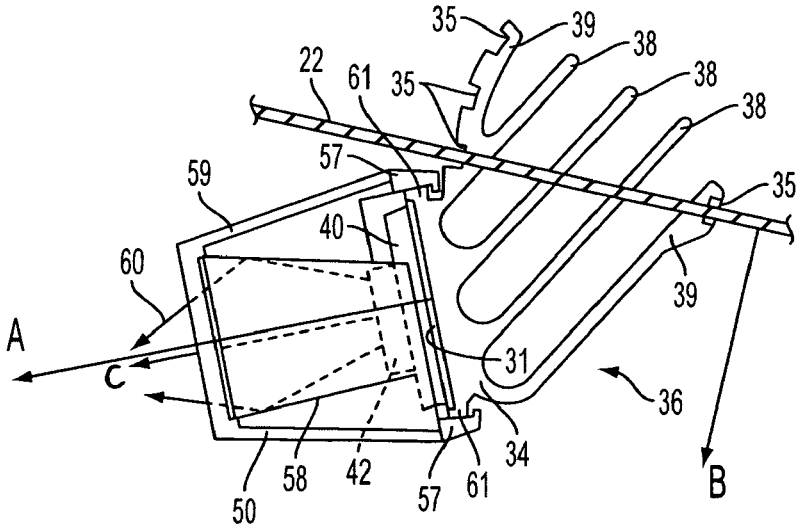
FIG. 6 is a side elevational view of an LED module as seen in FIG. 5.

In an exemplary implementation as illustrated in FIG. 6, heat sink 30 includes a first part 34 having a mounting surface 31 for mounting LED circuit board 40 thereon, and a second part 36 comprised of a first set of fins 38 and second set of fins 39 that extend from the first part 34. The first set of fins 38 and/or the second set of fins 39 can be oriented at an angle (for example, an acute angle) with respect to the plane of surface 31. This orientation facilitates mounting of the LED circuit board 40 so that light 60 emitted from its LEDs 42 is at an angle (for example, an acute angle) with respect to the plane of the carrier plate 22.

In an exemplary implementation, as further illustrated in, for example, FIG. 6, LED module 20 directs light 60 emitted from the three illustrated LEDs 42 along a first longitudinal axis A which is at an acute angle with respect to axis B normal to the carrier plate 22. In a more specific exemplary implementation that facilitates directing of light in, for example, street illumination applications, module 20 can be configured with respect to the carrier plate such that axis A and axis B are oriented at an acute angle relative to one another to direct emission of light from a light fixture (see, for example light M from a luminaire 10 of FIG. 1) incorporating such a module at an angle between 60.degree. and 80.degree., and advantageously about 70.degree. for certain specific lighting implementation noted above, to achieve the desired light distribution onto the ground or surface to be illuminated by the light fixture.

Heat sinks 30 dissipate heat from the LED boards 40 and allow the boards 40 to cool adequately to survive the applicable implementation environment. According to an exemplary implementation, each module 20 can be configured, for example to snap fit into corresponding structures of the carrier plate 22, to achieve a toolless connection of modules 20 to carrier plate 22.

According to an exemplary embodiment, fins 39 of the heat sink 30 can include at least one recess 35 to facilitate snap fitting of the heat sink 30, and thereby module 20, into a corresponding opening or aperture 23 of a carrier plate 22. As seen in FIG. 6*b*, at least one of the fins 39 can include multiple recesses 35*a*, 35*b*, 35*c* to allow for different mounting orientations, increasing or decreasing the amount of heat sink body 32 projecting from the bottom surface of the carrier plate 22 and changing the angle of the plane of mounting surface 31 with respect to the plane of the carrier plate 22 (or stated another way, varying the angle between axis A and axis B, see FIG. 6). For example, by engaging corresponding edge of opening 23 within one of the recesses 35*a*, 35*b*, or 35*c* while the opposite edge of opening 23 remains engaged within recess 35*d*, the orientation of the LED module 20 with respect to the carrier plate 22 would change such that the angle of light emitted from LEDs 42 would increase or decrease with respect to the plane of the carrier plate 22. In an exemplary implementation, the configuration of recesses 35*a*, 35*b*, 35*c* and 35*d* on fins 39 can be such that snap fitting of module 20 into opening 23 of carrier plate 22 allows for adjustment of the direction of the light emitted from LEDs 42 based on the recess engaging the edge of opening 23. For example, depending on which of the recesses 35*a*, 35*b* or 35*c* engages the edge of opening 23, the direction of light emitted from module 22 can be selectively adjusted such that the angle between axis A and axis B is changed. In an exemplary implementation adjustment of the mounting orientation of the LED modules 20 on the carrier plate 22 facilitates adjustment of the direction and or pattern of light emitted from a fixture incorporating such a carrier plate and LED modules.

In an exemplary implementation, each of the LED circuit boards 40 includes at least one, or as illustrated in the drawings three, LEDs 42 mounted thereon. The LED circuit board 40 is configured with respect to the heat sink module 30 so that the heat from all LEDs accommodated and mounted on the LED circuit board 40 is dissipated by means of heat sink 30. The LEDs 42 are positioned horizontally as shown, for example in FIGS. 6*a* and 6*b*, but any configuration of LEDs 42 on the LED circuit board 40 is within the scope of the invention. Likewise, any type of LED 42 can be used because the LED circuit board 40 can be universal.

In the illustrated exemplary implementations of the embodiments of the present invention, the plane of the planar LED circuit board 40 is substantially parallel to the planar mounting surface 31 when LED circuit board is attached to the heat sink 30. This configuration enables the angle between the plane of the LED circuit board 40 and the carrier plate 22 to be essentially the same as the angle between the plane of the mounting surface 31 of the heat sink 30 and the carrier plate 22. Thus, if orientation of the mounting surface 31 is changed with respect to the carrier plate 22, the orientation of the LED circuit board 40 is analogously changed. According to an exemplary embodiment of the present invention, when a lighting fixture, for example a luminaire as shown in FIGS. 1-4, incorporating a carrier plate 22, is configured such that the carrier plate 22 is parallel to the surface 16 to be illuminated (for example, ground surface in a street light applications), the angle of emitted light M with respect to the normal to the surface 16 to be illuminated can be directly related to the angle between axis A and axis B of the LED modules configured on the carrier plate 22.

In certain exemplary configurations, the LED circuit board 40 is attached to the mounting surface 31 of the heat sink 30 with transfer thermal tape, grease, or a similar material. The attachment can be permanent or removable, for example for ease of replacement of individual board 40 should any LED mounted thereon fail. The LED circuit board 40 may also include a thermal sensor device (not shown) to monitor the heat on the LED circuit board 40 and to make adjustments if the board temperature rises beyond an acceptable value.

Figure 23:
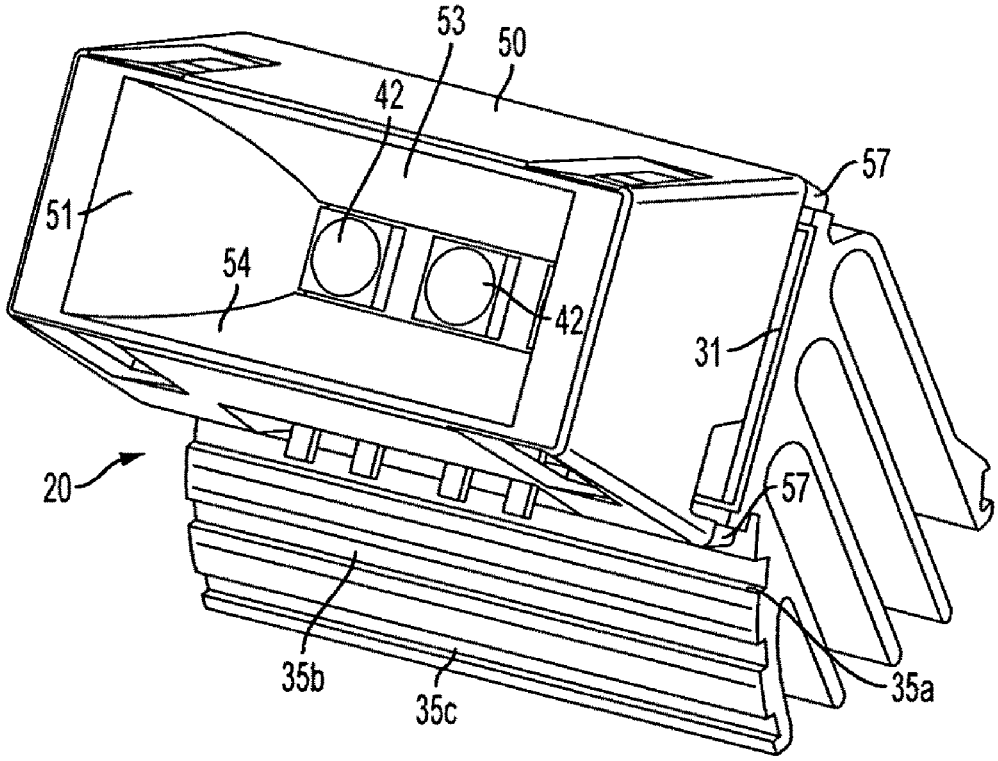
FIG. 23 is a side perspective view of an LED module having curved reflective walls according to an exemplary embodiment of the invention.
Figure 24:
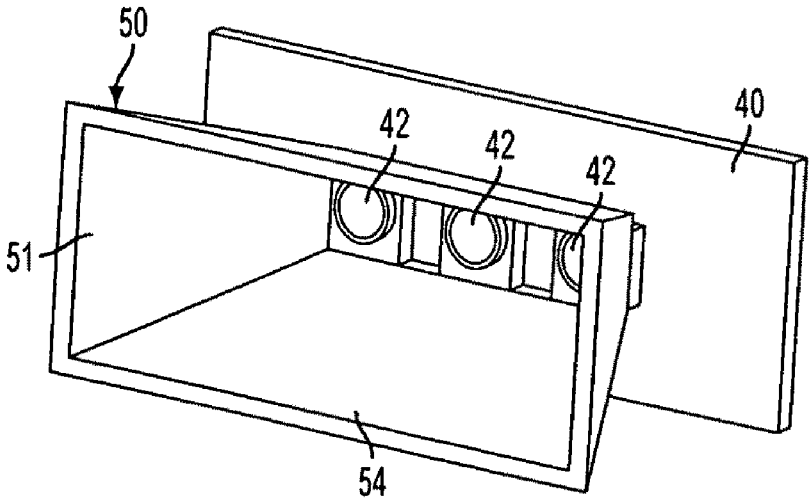
FIG. 24 is a front perspective view of a reflector module according to an exemplary embodiment of the invention.

According to an exemplary embodiment of the present invention, reflector 50 is configured with respect to LEDs 42 and the heat sink 30. In an exemplary implementation, reflector 50 is plastic molded and generally constructed and configured to direct light from LEDs 42 outward along the axis A generally perpendicular to the plane of the LED circuit board 40 (see FIG. 6). According to an exemplary non-limiting implementation, the reflector 50 includes a reflective surface 58 (see FIG. 6) comprised of, for example, four outwardly diverging reflective surfaces 51, 52, 53, 54 that form a truncated pyramidal configuration (see FIG. 6*a*) for reflecting light emitted from the LED diodes 42. Referring to examples of FIGS. 6 and 6*a*, reflector 50 also includes a housing 59 that accommodates reflectors 51-54 and includes a means for disposing reflector 50 with respect to LEDs 52. As shown in FIG. 23, the reflective surfaces can, for example, be curved. Further, as shown in the example of FIG. 24, reflector 50 can be configured without a housing (as shown in FIG. 6*a*) to attach to the LED circuit board 40 rather than a heat sink to, for example, provide an alternative arrangement to facilitate replacement of defective LEDs 42.

In an exemplary implementation, the reflectors 50 increase the output of the LED circuit board 40 by gathering light emitted by the LEDs 42 and redirecting it along the axis generally perpendicular to the plane of LED circuit board 40, essentially doubling the center beam candlepower. According to an exemplary configuration, the light emitted from LEDs 42 is increased by as much as 250% in the horizontal plane by means of the reflectors 50. A configuration of three LEDs 42 within a reflector 50 facilitates horizontal distribution of light emitted from the three horizontally positioned LEDs as a means to spread the light across the surface to be illuminated at high angles.

Figure 6A:
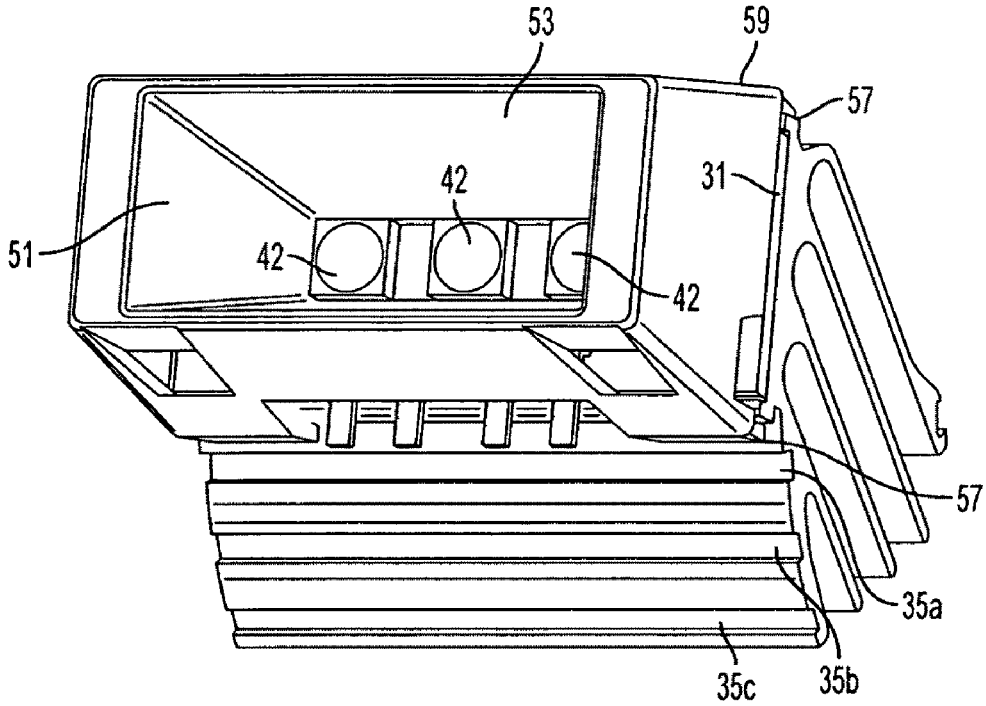
FIG. 6*a* is a side perspective view of the LED module as seen in FIGS. 5 and 6.
Figure 6B:
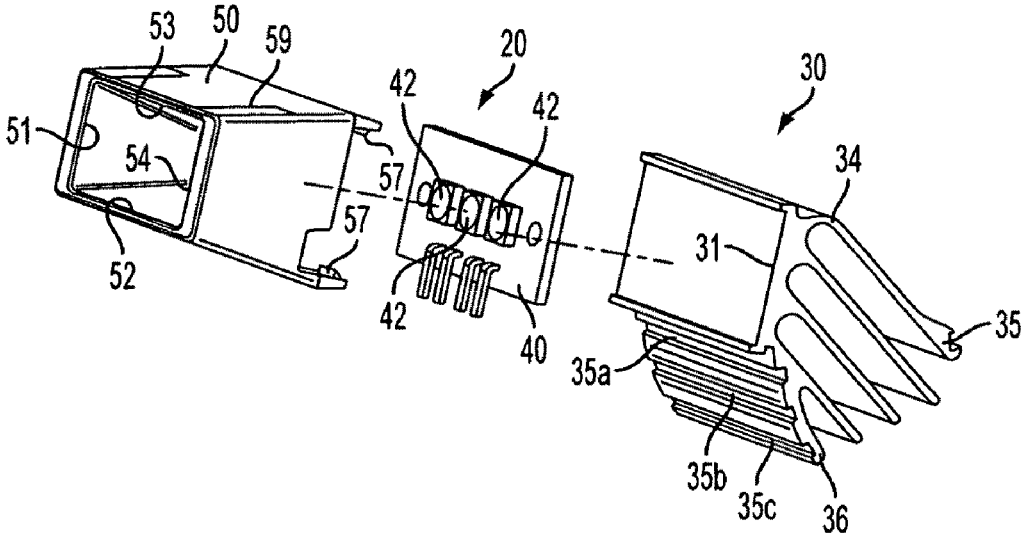
FIG. 6B is an exploded view of the LED module as seen in FIGS. 5-6A.

In an exemplary implementation, the reflectors 50 can be coupled to and fitted, for example snap fitted, onto the heat sink 30, as shown for example in FIGS. 6 and 6*a*. For example, housing 59 of the reflector 50 can be configured to include projections 57 designed to fit snugly over, or engage with, side edges 61 of the mounting surface 31 of the heat sink 30 to secure the reflector 50 thereto.

Figure 5:
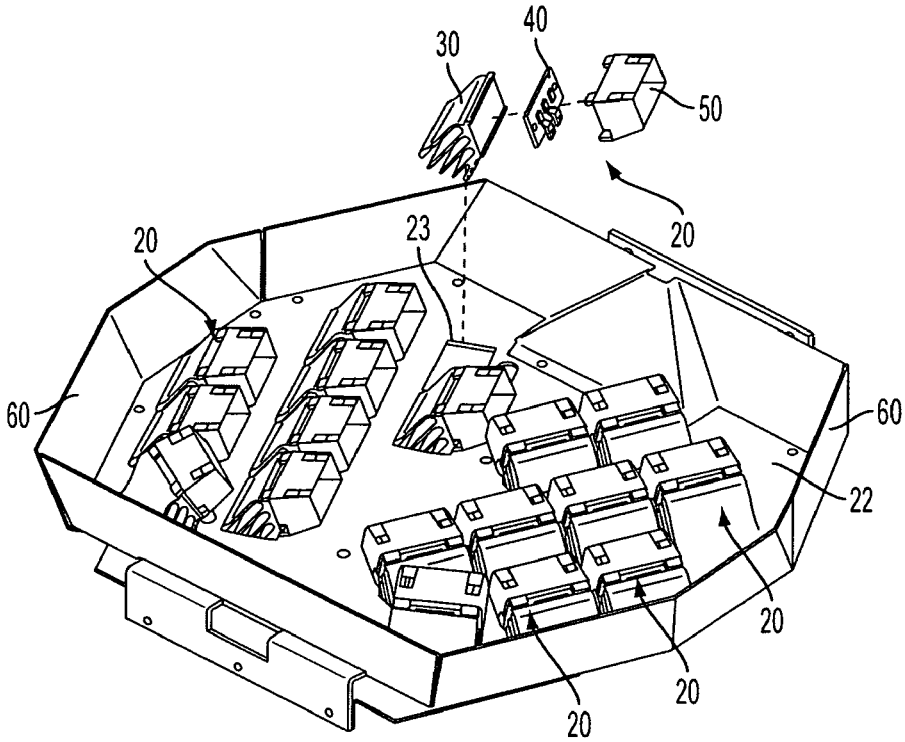
FIG. 5 is a side perspective view of a carrier plate according to an exemplary embodiment of the present invention with an exploded view of one of the LED modules according to an exemplary embodiment of the present invention.
Figure 7:
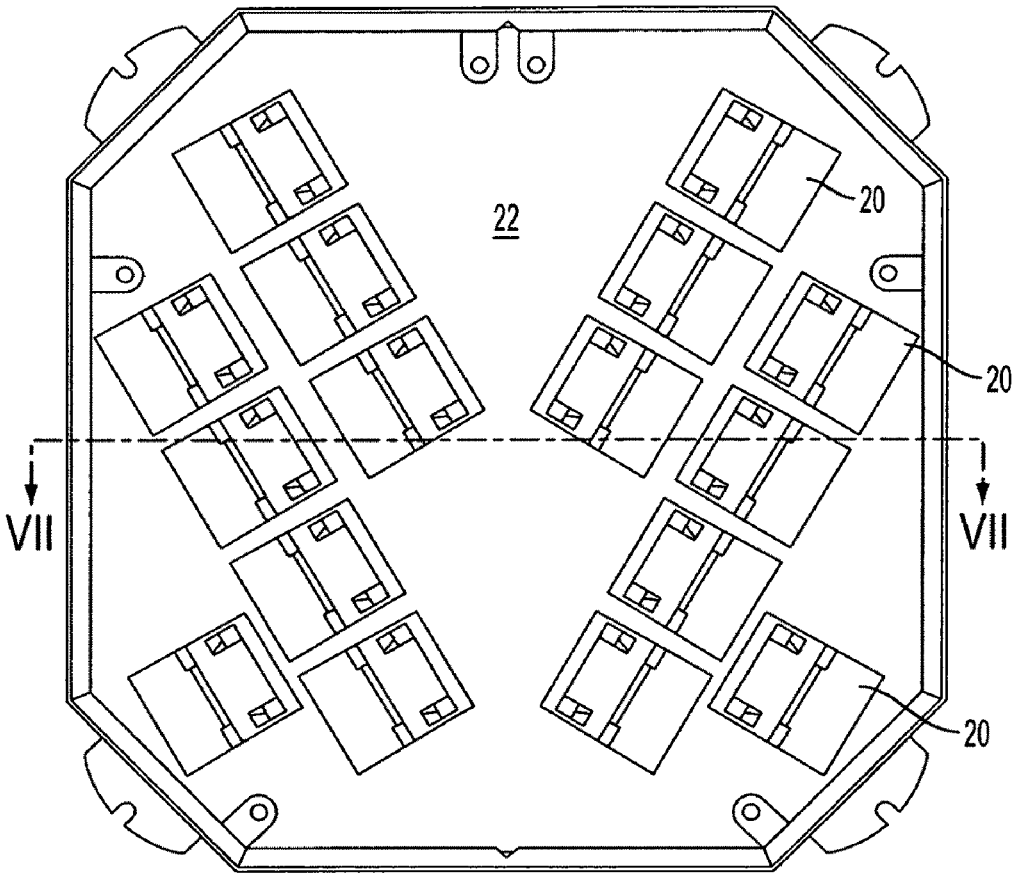
FIG. 7 is a top plan view of the carrier plate as seen in FIGS. 4 and 5.
Figure 8:
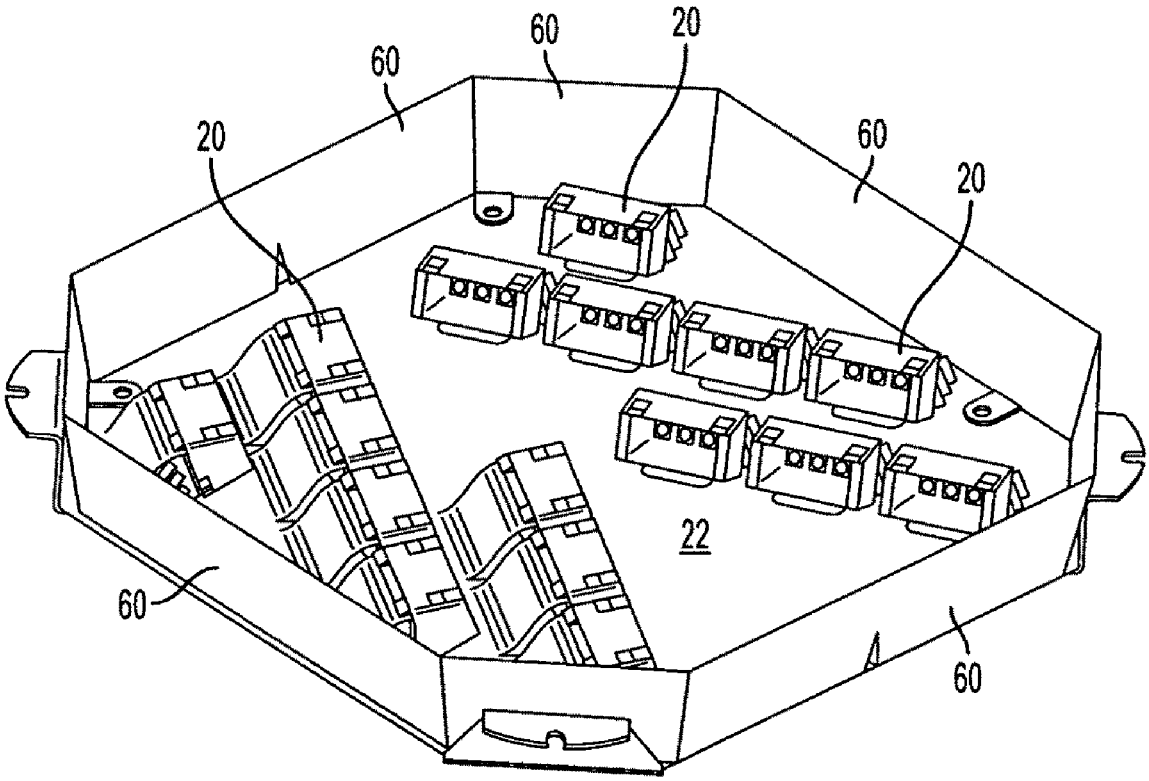
FIG. 8 is a side perspective view of the carrier plate as seen in FIG. 7.

According to an exemplary embodiment of the present invention, carrier plate 22 can be configured to include, or with respect to, reflector panels 60, as shown for example in FIGS. 3, 5, and 8. The reflector panels 60 are strategically placed to redirect the flux from the higher beams of the LEDs 42 toward the desired area to be illuminated. In an exemplary embodiment, the combination of LED modules 20 and reflector panels 60 creates five distinct lighting distributions, as described below. In each of the lighting distributions, the LED modules 20 are arranged on a carrier plate 22 that fits within the housing 12, as illustrated in FIGS. 7-17. The LED modules 20 are adaptable to all areas of illumination and lighting applications. All the typical lighting distributions can be achieved by appropriate placement of the LED modules 20 on the carrier plate 22, as described below.

In an exemplary implementation, each of the modules 20 is oriented on the carrier plate 22 to form an LED array that facilitates directing of light exiting the LED arrays to form a beam having a desired shape (or footprint) whose optical axis (or axis corresponding the maximum candlepower) hits the surface to be illuminated at an angle of approximately 60° to 80°, or about 70° depending on the application, as illustrated in the example of FIG. 1. Placement of the LED modules 20 (shown in the following figures) on the carrier plate 22 controls the beam shape, for example to conform to a type known in the art, per IES NEMA regulations and illustrated as Type I, Type II, Type III, Type IV, or Type V in respective FIG. 18-22.

Figure 10:
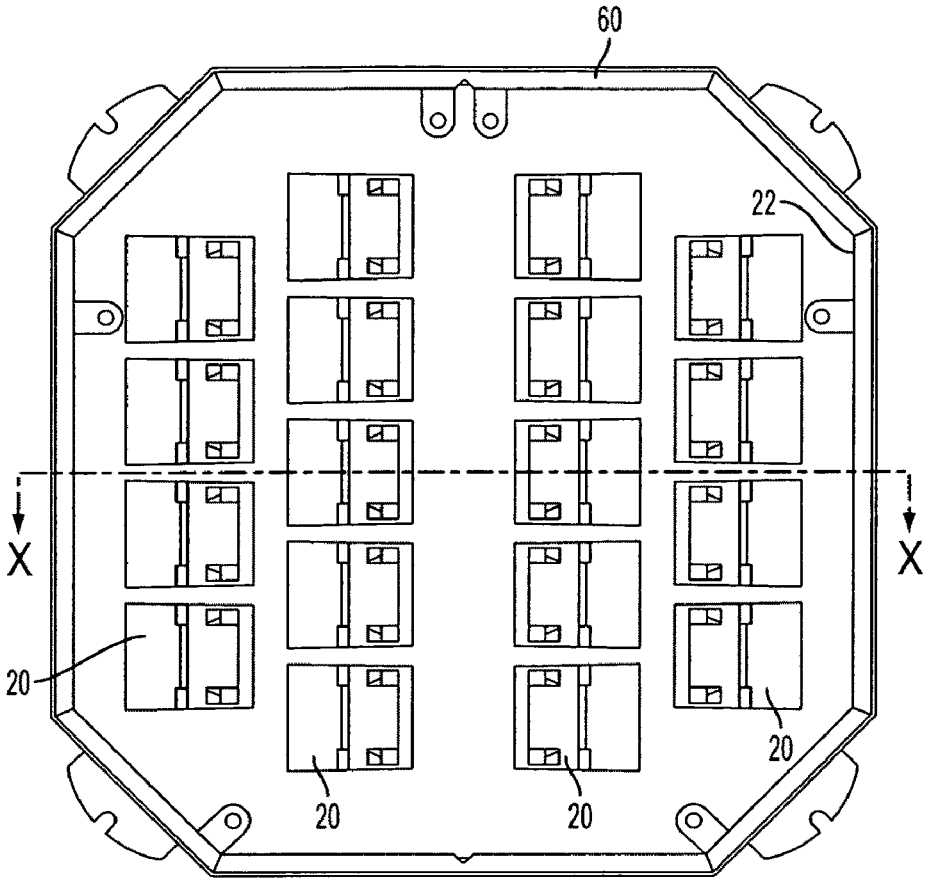
FIG. 10 is a top plan view of the carrier plate according to an exemplary embodiment of the present invention.
Figure 11:
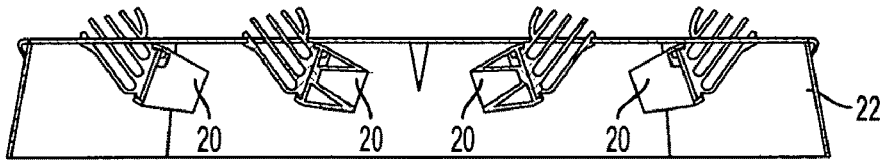
FIG. 11 is a cross-sectional view of the carrier plate taken along line X-X in FIG. 10.
Figure 18:
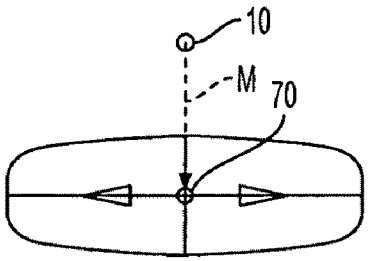
FIG. 18 is a schematic of a lighting distribution according to the arrangement shown in FIGS. 10 and 11.

FIG. 18 illustrates a light pattern corresponding to a Type I beam shape. According to an exemplary embodiment of the present invention, to achieve this pattern of light distribution, the LED modules 20 are arranged on the carrier plate 22 as illustrated in FIGS. 10 and 11. In an exemplary implementation of FIGS. 10 and 11, the array of LED modules 20 comprises LED modules 20 arranged substantially in parallel and substantially in a bilateral symmetry with respect to a horizontal center line of the carrier plate 22. The LED modules 20 are inwardly facing at 90° with respect to the horizontal center line whereby the light emitted from the LED modules 20 is directed towards the horizontal center line of the carrier plate 22 to achieve the angular displacement in the illumination pattern of substantially 90°, as seen in FIG. 18. In Type I, the pattern of illumination projects at about 90° with respect to the optical axis 70 of the beam emitted from the light fixture (see beam M of FIG. 1).

Figure 12:
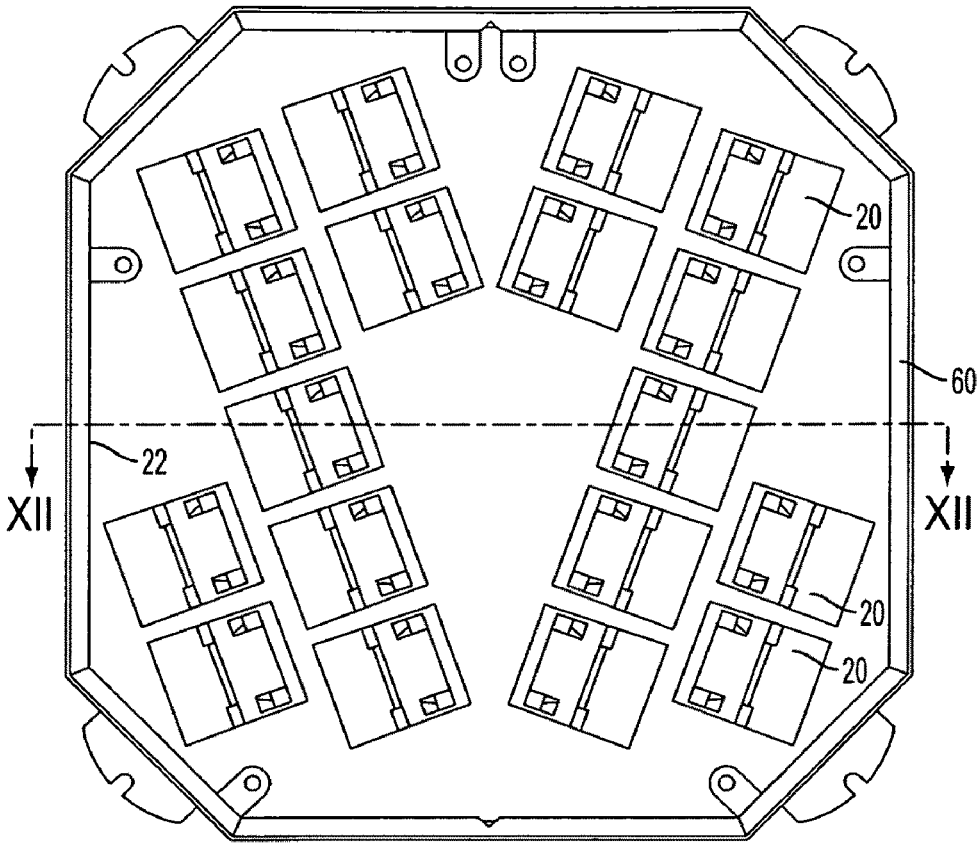
FIG. 12 is a top plan view of the carrier plate according to an exemplary embodiment of the present invention.
Figure 13:
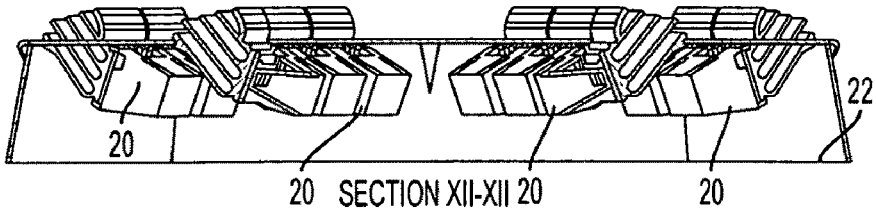
FIG. 13 is a cross-sectional view of the carrier plate taken along line XII-XII in FIG. 12.
Figure 19:
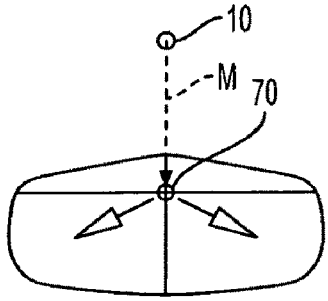
FIG. 19 is a schematic of a lighting distribution according to the arrangement shown in FIGS. 12 and 13.

FIG. 19 illustrates a light pattern corresponding to a Type II beam shape. According to an exemplary embodiment of the present invention, to achieve this pattern of light distribution, the LED modules are arranged on the carrier plate 22 as illustrated in FIGS. 12 and 13. In an exemplary implementation of FIGS. 12 and 13, the array of LED modules 20 comprises LED modules 20 arranged substantially in parallel and substantially in a bilateral symmetry with respect to a horizontal center line of the carrier plate 22. The LED modules 20 are inwardly facing at 70° with respect to the horizontal center line whereby the light emitted from the LED modules 20 is directed towards the horizontal center line of the carrier plate 22 to achieve the angular displacement in the illumination pattern of substantially 70°, as seen in FIG. 19. In Type II, the pattern of illumination projects at about 70° with respect to the optical axis 70 of the main beam.

Figure 9:
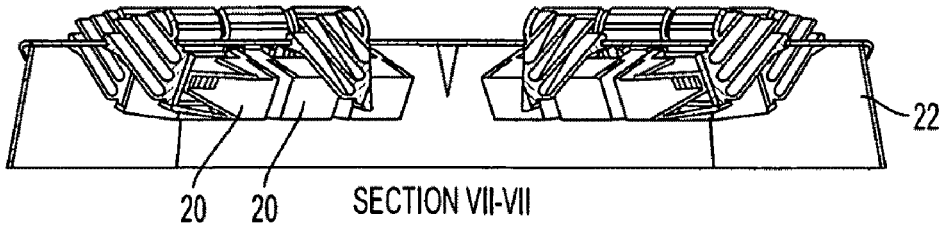
FIG. 9 is a cross-sectional view of the carrier plate taken along line VII-VII in FIG. 7.
Figure 20:
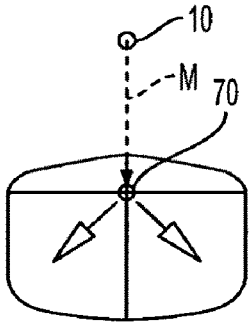
FIG. 20 is a schematic of a lighting distribution according to the arrangement shown in FIGS. 7-9.

FIG. 20 illustrates a light pattern corresponding to a Type III beam shape. According to an exemplary embodiment of the present invention, to achieve this pattern of light distribution, the LED modules are arranged on the carrier plate 22 as illustrated in FIGS. 7-9. In an exemplary implementation of FIGS. 7-9, the array of LED modules 20 comprises LED modules 20 arranged substantially in parallel and substantially in a bilateral symmetry with respect to a horizontal center line of the carrier plate 22. The LED modules 20 are inwardly facing at 60° with respect to the horizontal center line whereby the light emitted from the LED modules 20 is directed towards the horizontal center line of the carrier plate 22 to achieve the angular displacement in the illumination pattern of substantially 60°, as seen in FIG. 20. In Type III, the pattern of illumination projects at about 60° with respect to the optical axis 70 of the beam.

Figure 14:
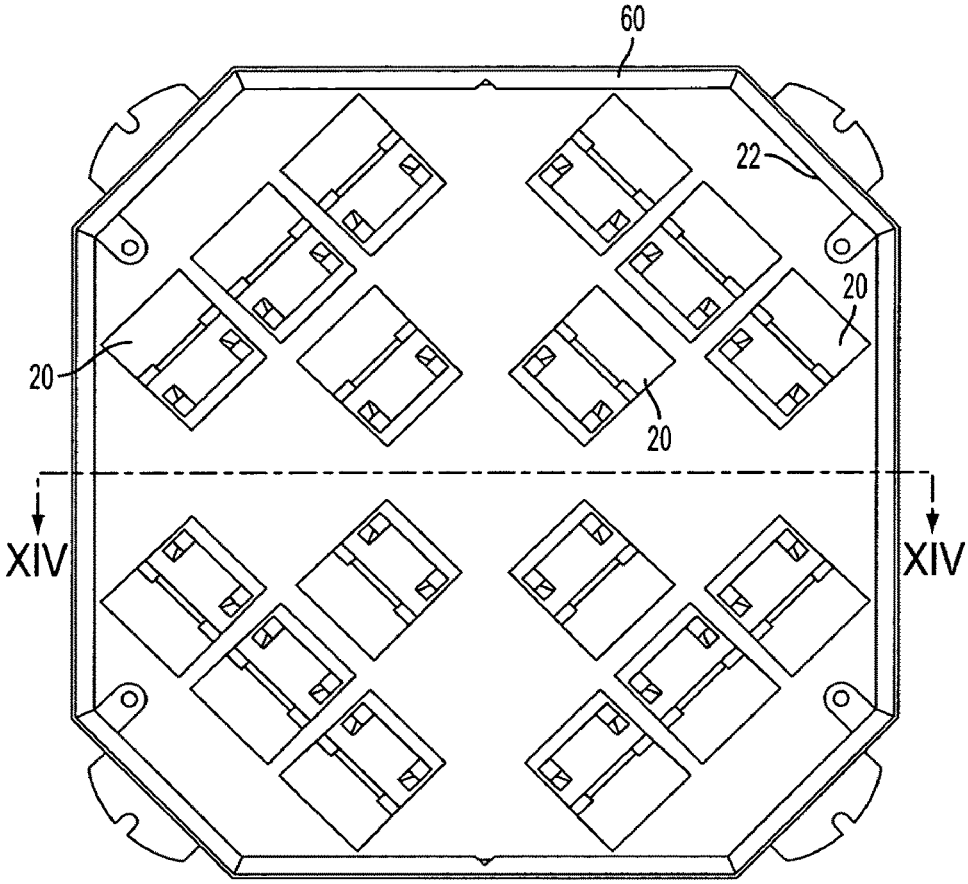
FIG. 14 is a top plan view of the carrier plate according to an exemplary embodiment of the present invention.
Figure 15:
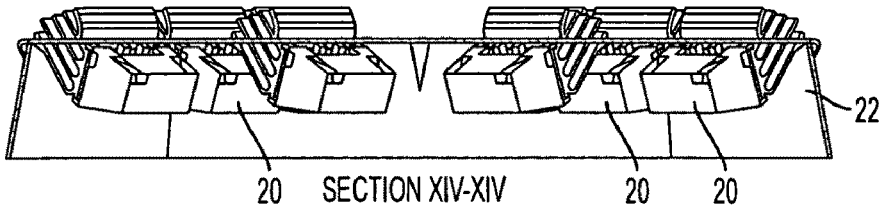
FIG. 15 is a cross-sectional view of the carrier plate taken along line XIV-XIV in FIG. 14.
Figure 21:
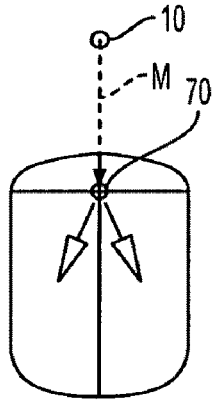
FIG. 21 is a schematic of a lighting distribution according to the arrangement shown in FIGS. 14 and 15.

FIG. 21 illustrates a light pattern corresponding to a Type IV beam shape. According to an exemplary embodiment of the present invention, to achieve this pattern of light distribution, the LED modules are arranged on the carrier plate 22 as illustrated in FIGS. 14 and 15. In an exemplary implementation of FIGS. 14 and 15, the array of LED modules 20 comprises LED modules 20 arranged substantially in parallel and substantially in a bilateral symmetry with respect to a horizontal center line of the carrier plate 22. The LED modules 20 are inwardly facing at 30° with respect to the horizontal center line whereby the light emitted from the LED modules 20 is directed towards the horizontal center line of the carrier plate 22 to achieve the angular displacement in the illumination pattern of substantially 30°, as seen in FIG. 21. In Type IV, the pattern of illumination projects at about 30° with respect to the optical axis 70 of the beam.

Figure 16:
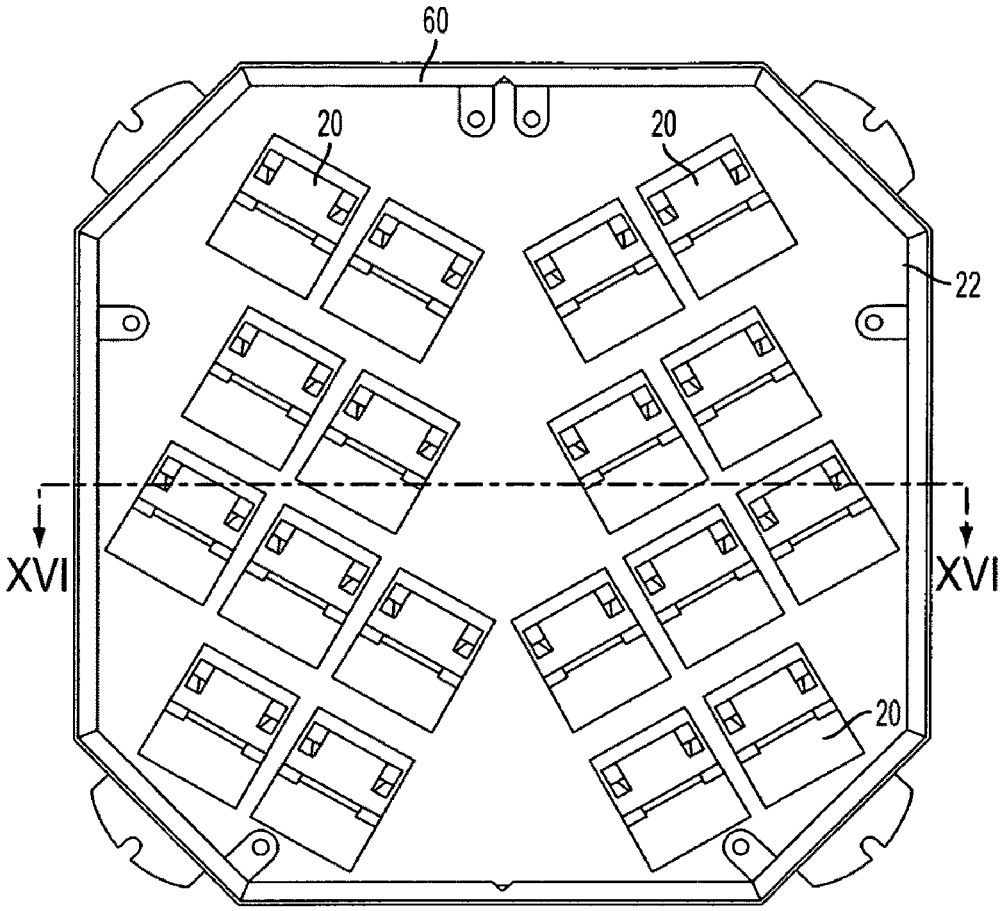
FIG. 16 is a top plan view of the carrier plate according to an exemplary embodiment of the present invention.
Figure 17:
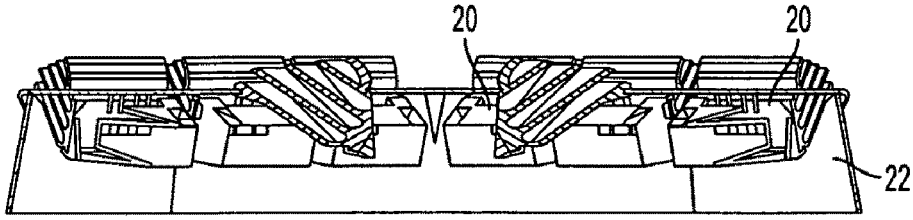
FIG. 17 is a cross-sectional view of the carrier plate taken along line XVI-XVI in FIG. 16.
Figure 22:
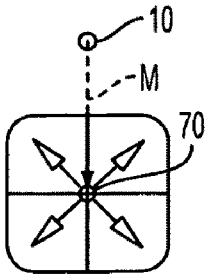
FIG. 22 is a schematic of a lighting distribution according to the arrangement shown in FIGS. 16 and 17.

FIG. 22 illustrates a light pattern corresponding to a Type V beam shape. According to an exemplary embodiment of the present invention, to achieve this pattern of light distribution, the LED modules are arranged on the carrier plate 22 as illustrated in FIGS. 16 and 17. In an exemplary implementation of FIGS. 16 and 17, the array of LED modules 20 comprises LED modules 20 arranged substantially in parallel and substantially symmetrically with respect to the center of the carrier plate 22. The LED modules 20 are inwardly facing at 45° with respect to the center line whereby the light emitted from the LED modules 20 is directed towards the center of the carrier plate 22 to achieve the angular displacement in the illumination pattern of substantially 45° in all directions, as seen in FIG. 22. In Type V, the pattern of illumination projects at about 45° in four directions with respect to the optical axis 70 of the beam.

While exemplary embodiments of the present invention have been chosen to illustrate the invention, it will be understood by those skilled in the art that various changes, modifications, additions, and substitutions are possible, without departing from the scope and spirit of the present invention. Therefore, the present invention is not limited to the above-described embodiments, but is defined by the following claims, along with their full scope of equivalents.

What is claimed is:

1. A light emitting diode (LED) module comprising:

an LED circuit board comprising at least one LED chip;

a reflective surface disposed with respect to said at least one LED chip to direct light emitted from said at least one LED chip toward an axis A extending away from and substantially perpendicular to a plane containing the LED circuit board, and a heat sink formed of heat transmitting material and comprising:

a mounting surface for accommodating said LED circuit board thereon to dissipate heat from the at least one LED chip, and a heat dissipation portion extending away from said mounting surface and comprising an engaging portion for attachment to a carrier plate such that at least one of said plane of said LED circuit board and a plane of said mounting surface of said heat sink is not parallel to a local plane of said carrier plate immediately adjacent to said LED circuit board, wherein said engaging portion comprises a plurality of recesses for selectively receiving an edge of an opening in said carrier plate when said heat dissipation portion is disposed within said opening to vary an angle of said plane of said mounting surface with respect to said local plane of said carrier plate to adjust the direction of light emitted from said LED module.

2. The LED module according to claim 1, wherein an axis B is substantially perpendicular to said local plane of said carrier plate; and an angle between said axis A and said axis B is within a range of about 60° to about 80°.

3. The LED module according to claim 1, wherein an axis B is substantially perpendicular to said local plane of said carrier plate; and an angle between said axis A and said axis B is about 70°.

4. The LED module according to claim 1, wherein said LED circuit board is disposed on said mounting surface such that the plane of said LED circuit board is substantially parallel to said mounting surface; and the light emitted from said at least one LED chip is substantially perpendicular to said plane of the mounting surface.

5. The LED module according to claim 1, wherein said heat dissipation portion comprises fins extending away from said mounting surface at an angle of less than 90° with respect to said plane of said mounting surface.

6. The LED module according to claim 1, wherein said reflective surface comprises a first longitudinal axis C that substantially coincides with said axis A.

7. The LED module according to claim 6, wherein said reflective surface is disposed with respect to said mounting surface such that said axis C is perpendicular to said plane of said mounting surface.

8. The LED module according to claim 6, wherein said reflective surface is supported by at least one of said LED circuit board and said heat sink.

9. The LED module according to claim 6, wherein said reflective surface comprises a plurality of flat or curved surfaces forming substantially a truncated pyramidal configuration having axial symmetry with respect to said axis C.

10. The LED module according to claim 1, wherein said LED circuit board is removably attached to said mounting surface and having at least one of transfer thermal tape or grease disposed therebetween.

11. An LED array comprising:

a plurality of LED modules and a carrier plate having a plurality of receiving portions for respectively accommodating said plurality of LED modules, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein for each of said LED modules, said axis A thereof is not perpendicular to a local plane of said carrier plate immediately adjacent to the LED circuit board thereof, and wherein said plurality of LED modules are selectively engaged with respective receiving portions of said carrier plate to generate a selected pattern of cumulative light emitted by said plurality of LED modules at one of:

about 90° with respect to an optical axis of said cumulative light;

about 70° with respect to said optical axis of said cumulative light;

about 60° with respect to said optical axis of said cumulative light;

about 30° with respect to said optical axis of said cumulative light; or about 45° in four directions with respect to said optical axis of said cumulative light.

12. The LED array according to claim 11, wherein for each of said LED modules, at least one of said plane of its LED circuit board and a plane of said mounting surface of its heat sink is not parallel to the respective local plane of said carrier plate.

13. The LED array according to claim 11, wherein said axis A is not perpendicular to a surface illuminated by light emitted from said plurality of LED modules.

14. The LED array according to claim 11, further comprising a reflector arranged substantially along a perimeter of said carrier plate and extending away from said carrier plate in direction of light emitted by said plurality of LED modules.

15. The LED array according to claim 11, wherein each of said LED modules is coupled to said carrier plate in a snap fit arrangement of said respective engaging and receiving portions.

16. The LED array according to claim 11, wherein for each of said LED modules, its engaging portion selectively couples with a respective receiving portion of said carrier plate to selectively adjust an angle between its axis A and the respective local plane of said carrier plate.

17. The LED array according to claim 11, wherein for each of said LED modules, an axis B is substantially perpendicular to the respective local plane of said carrier plate; and an angle between its axis A and said axis B is within a range of about 60° to about 80°.

18. The LED array according to claim 11, wherein for each of said LED modules, an axis B is substantially perpendicular to the respective local plane of said carrier plate; and an angle between its axis A and said axis B is about 70°.

19. The LED array according to claim 11, wherein for each of said LED modules, an angle between its axis A and a plane of a surface to be illuminated by a cumulative light emitted from said plurality of LED modules is within a range of about 60° to about 80°.

20. The LED array according to claim 11, wherein for each of said LED modules, an angle between its axis A and a plane of a surface to be illuminated by a cumulative light emitted from said plurality of LED modules is about 70°.

21. A light fixture comprising:

a plurality of LED modules, each of said LED modules comprising:

an LED circuit board comprising at least one LED chip, a heat sink formed of heat transmitting material and comprising a mounting surface for accommodating said LED circuit board thereon to dissipate heat from the at least one LED chip, and a reflective surface disposed with respect to said at least one LED chip to direct light emitted from said at least one LED chip toward an axis A extending away from and substantially perpendicular to a plane of the LED circuit board;

a carrier plate having said plurality of LED modules rigidly disposed thereon;

a housing for accommodating said carrier plate therein; and a support structure comprising a pole extending from a surface to be illuminated and supporting said housing at a selected height with respect to said surface to be illuminated by a cumulative light emitted by said plurality of LED modules;

wherein said axis A is not perpendicular to a plane of said surface to be illuminated by said plurality of LED modules.

22. The light fixture according to claim 21, wherein said support structure further comprises an arm supporting said housing on said pole.

23. The light fixture according to claim 21, wherein an axis B is substantially perpendicular to a plane of said carrier plate; and an angle between said axis A and said axis B is within a range of about 60° to about 80°.

24. The light fixture according to claim 21, wherein an axis B is substantially perpendicular to said plane of said carrier plate; and an angle between said axis A and said axis B is about 70°.

25. The light fixture according to claim 21, wherein an angle between said axis A and a plane of said surface to be illuminated is within a range of about 60° to about 80°.

26. The light fixture according to claim 21, wherein an angle between said axis A and a plane of said surface to be illuminated is about 70°.

27. The light fixture according to claim 21, wherein the support structure secures said housing with respect to said surface to be illuminated by said plurality of LED modules at a height x; and an area of greatest illumination by said cumulative light emitted by said plurality of LED modules is located on said surface to be illuminated at a distance of approximately 2.75× when measured from a location directly below said LED array.

28. The light fixture according to claim 21, wherein a selected pattern of said cumulative light projects on said surface to be illuminated at one of:

about 90° with respect to an optical axis of said cumulative light;

about 70° with respect to said optical axis of said cumulative light;

about 60° with respect to said optical axis of said cumulative light;

about 30° with respect to said optical axis of said cumulative light; or about 45° in four directions with respect to said optical axis of said cumulative light.

29. A method of illumination utilizing a plurality of LED modules fixed relative to a surface to be illuminated, each of said LED modules comprising:

an LED circuit board comprising at least one LED chip, a heat sink formed of heat transmitting material and comprising a mounting surface for accommodating said LED circuit board thereon to dissipate heat from the at least one LED chip, and a reflective surface disposed with respect to said at least one LED chip to direct light emitted from said at least one LED chip toward an axis A extending away from and substantially perpendicular to a plane of the LED circuit board, said method comprising arranging said plurality of LED modules rigidly on a carrier plate such that said axis A is not perpendicular to a plane of said surface to be illuminated when the carrier plate is fixed relative to said surface to be illuminated, and so that a selected pattern of said cumulative light emitted by said plurality of LED modules projects on said surface to be illuminated at one of:

about 90° with respect to an optical axis of said cumulative light;

about 70° with respect to said optical axis of said cumulative light;

about 60° with respect to said optical axis of said cumulative light;

about 30° with respect to said optical axis of said cumulative light; or about 45° in four directions with respect to said optical axis of said cumulative light.

30. The method according to claim 29, wherein an axis B is substantially perpendicular to said plane of said carrier plate; and said arranging comprises fitting said LED modules to said carrier plate such that an angle between said axis A and said axis B is within a range of about 60° to about 80°.

31. The method according to claim 29, wherein an axis B is substantially perpendicular to said plane of said carrier plate; and said arranging comprises fitting said LED modules to said carrier plate such that an angle between said axis A and said axis B is about 70°.

32. The method according to claim 29, wherein said arranging comprises fitting said LED modules to said carrier plate such that an angle between said axis A and a plane of said surface to be illuminated is within a range of about 60° to about 80°.

33. The method according to claim 29, wherein said arranging comprises fitting said LED modules to said carrier plate such that an angle between said axis A and a plane of said surface to be illuminated is about 70°.

34. The method according to claim 29, further comprising:

securing said LED array within a housing;

elevating said housing with respect to said surface to be illuminated by said plurality of LED modules at a height x; and locating an area of greatest illumination by said cumulative light emitted by said plurality of LED modules is on said surface to be illuminated at a distance of approximately 2.75× when measured from a location directly below said LED array.

35. A heat sink for an LED module, the heat sink comprising:

a mounting surface for accommodating only a single LED circuit board thereon to dissipate heat from said single LED circuit board; and a heat dissipation portion extending away from said mounting surface at an angle of less than 90° with respect to a plane of said mounting surface and comprising an engaging portion for securing said LED module to a carrier plate, said engaging portion having a plurality of recesses for selectively receiving an edge of an opening in said carrier plate to vary an angle of said plane of said mounting surface with respect to a plane of said carrier plate.

36. The heat sink according to claims 35, wherein said heat dissipation portion comprises fins extending away from said mounting surface at an angle of less than 90° with respect to said plane of said mounting plate.

37. An LED array comprising:

a plurality of LED modules and a carrier plate having a plurality of receiving portions for respectively accommodating said plurality of LED modules, which together generate a pattern of cumulative light, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein said plurality of LED modules are engaged with respective receiving portions of said carrier plate such that:

for each of said LED modules, said axis A thereof is not perpendicular to a local plane of said carrier plate immediately adjacent to the LED circuit board thereof, and said LED modules are substantially in parallel and substantially in a bilateral symmetry with respect to a horizontal center line of said carrier plate, and are inwardly facing at 90° with respect to the horizontal center line whereby the light emitted from said LED modules is directed towards the horizontal center line of said carrier plate to project said pattern of cumulative light at about 90° with respect to an optical axis of said cumulative light.

38. An LED array comprising:

a plurality of LED modules and a carrier plate having a plurality of receiving portions for respectively accommodating said plurality of LED modules, which together generate a pattern of cumulative light, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein said plurality of LED modules are engaged with respective receiving portions of said carrier plate such that:

for each of said LED modules, said axis A thereof is not perpendicular to a local plane of said carrier plate immediately adjacent to the LED circuit board thereof, and said LED modules are substantially in parallel and substantially in a bilateral symmetry with respect to a horizontal center line of said carrier plate, and are inwardly facing at 70° with respect to the horizontal center line whereby the light emitted from said LED modules is directed towards the horizontal center line of said carrier plate to project said pattern of cumulative light at about 70° with respect to an optical axis of said cumulative light.

39. An LED array comprising:

a plurality of LED modules and a carrier plate having a plurality of receiving portions for respectively accommodating said plurality of LED modules, which together generate a pattern of cumulative light, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein said plurality of LED modules are engaged with respective receiving portions of said carrier plate such that:

for each of said LED modules, said axis A thereof is not perpendicular to a local plane of said carrier plate immediately adjacent to the LED circuit board thereof, and said LED modules are substantially in parallel and substantially in a bilateral symmetry with respect to a horizontal center line of said carrier plate, and are inwardly facing at 60° with respect to the horizontal center line whereby the light emitted from said LED modules is directed towards the horizontal center line of said carrier plate to project said pattern of cumulative light at about 60° with respect to an optical axis of said cumulative light.

40. An LED array comprising:

a plurality of LED modules and a carrier plate having a plurality of receiving portions for respectively accommodating said plurality of LED modules, which together generate a pattern of cumulative light, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein said plurality of LED modules are engaged with respective receiving portions of said carrier plate such that:

for each of said LED modules, said axis A thereof is not perpendicular to a local plane of said carrier plate immediately adjacent to the LED circuit board thereof, and said LED modules are substantially in parallel and substantially in a bilateral symmetry with respect to a horizontal center line of said carrier plate, and are inwardly facing at 30° with respect to the horizontal center line whereby the light emitted from said LED modules is directed towards the horizontal center line of said carrier plate to project said pattern of cumulative light at about 30° with respect to an optical axis of said cumulative light.

41. An LED array comprising:

a plurality of LED modules and a carrier plate having a plurality of receiving portions for respectively accommodating said plurality of LED modules, which together generate a pattern of cumulative light, each of said LED modules comprising:

an LED circuit board comprising at least one LED chip, a heat sink formed of heat transmitting material and comprising a mounting surface for accommodating said LED circuit board thereon to dissipate heat from the at least one LED chip, an engaging portion for attachment to said carrier plate, and a reflective surface disposed with respect to said at least one LED chip to direct light emitted from said at least one LED chip toward an axis A extending away from and substantially perpendicular to a plane containing the LED circuit board, wherein said plurality of LED modules are engaged with respective receiving portions of said carrier plate such that:

for each of said LED modules, said axis A thereof is not perpendicular to a local plane of said carrier plate immediately adjacent to the LED circuit board thereof, and said LED modules are substantially in parallel and substantially in a bilateral symmetry with respect to a horizontal center line of said carrier plate, and are inwardly facing at 45° with respect to the horizontal center line whereby the light emitted from said LED modules is directed towards the horizontal center line of said carrier plate to project said pattern of cumulative light at about 45° with respect to an optical axis of said cumulative light.

42. The LED module according to claim 1, wherein said axis A is not perpendicular to a plane containing a target surface illuminated by said light emitted from said at least one LED chip.

43. A heat sink for an LED module, the heat sink comprising:

a mounting surface for accommodating an LED circuit board thereon to dissipate heat from the LED circuit board; and a heat dissipation portion extending away from said mounting surface at an angle of less than 90° with respect to a plane of said mounting surface, wherein said heat dissipation portion comprises an engaging portion for securing said LED module to a carrier plate, said engaging portion comprising a plurality of recesses for selectively receiving an edge of an opening in said carrier plate when said heat dissipation portion is disposed within said opening to vary an angle of said plane of said mounting surface with respect to a plane of said carrier plate.

44. A light fixture comprising:

a plurality of LED modules, each of said LED modules comprising:

an LED circuit board comprising at least one LED chip, a heat sink formed of heat transmitting material and comprising a mounting surface for accommodating said LED circuit board thereon to dissipate heat from the at least one LED chip, and a reflective surface disposed with respect to said at least one LED chip to direct light emitted from said at least one LED chip toward an axis A extending away from and substantially perpendicular to a plane of the LED circuit board;

a carrier plate having said plurality of LED modules rigidly disposed thereon;

a housing for accommodating said carrier plate therein; and a support structure for securing said housing with respect to a surface to be illuminated by a cumulative light emitted by said plurality of LED modules;

wherein said axis A is not perpendicular to a plane of said surface to be illuminated by said plurality of LED, and wherein a selected pattern of said cumulative light projects on said surface to be illuminated at one of:

about 90° with respect to an optical axis of said cumulative light;

about 70° with respect to said optical axis of said cumulative light;

about 60° with respect to said optical axis of said cumulative light;

about 30° with respect to said optical axis of said cumulative light; or about 45° in four directions with respect to said optical axis of said cumulative light.

* * * * *